US005796314A

United States Patent [19]

Tantawi et al.

[11] Patent Number: 5,796,314

[45] Date of Patent: Aug. 18, 1998

[54] ACTIVE HIGH-POWER RF SWITCH AND PULSE COMPRESSION SYSTEM

[75] Inventors: Sami G. Tantawi, San Mateo; Ronald D. Ruth, Woodside; Max Zolotorev, Mountain View, all of Calif.

[73] Assignee: Stanford University, Stanford, Calif.

[21] Appl. No.: 847,058

[22] Filed: May 1, 1997

Related U.S. Application Data

[60] Provisional application No. 60/016,624, May 1, 1996 and provisional application No. 60/016,625, May 1, 1996.

[51] Int. Cl.[6] ..... H01P 1/22; H01P 5/04

[52] U.S. Cl. ..... 333/20; 327/181; 327/103; 333/81 B

[58] Field of Search ..... 333/1.1, 20, 81 B, 333/103, 125, 137, 157, 164, 288; 327/181

[56] References Cited

U.S. PATENT DOCUMENTS

| | | | |
|---|---|---|---|
| 3,812,437 | 5/1974 | Marx | 333/81 B |
| 3,949,328 | 4/1976 | Levaillant | 333/81 B |
| 4,115,708 | 9/1978 | Liu | 327/181 |
| 4,864,258 | 9/1989 | Garver et al | 333/20 |
| 5,099,214 | 3/1992 | Rosen et al. | 333/81 B |

*Primary Examiner*—Paul Gensler

*Attorney, Agent, or Firm*—Lumen Intellectual Property Services

[57] ABSTRACT

A high-power RF switching device employs a semiconductor wafer positioned in the third port of a three-port RF device. A controllable source of directed energy, such as a suitable laser or electron beam, is aimed at the semiconductor material. When the source is turned on, the energy incident on the wafer induces an electron-hole plasma layer on the wafer, changing the wafer's dielectric constant, turning the third port into a termination for incident RF signals, and, causing all incident RF signals to be reflected from the surface of the wafer. The propagation constant of RF signals through port 3, therefore, can be changed by controlling the beam. By making the RF coupling to the third port as small as necessary, one can reduce the peak electric field on the unexcited silicon surface for any level of input power from port 1, thereby reducing risk of damaging the wafer by RF with high peak power. The switch is useful to the construction of an improved pulse compression system to boost the peak power of microwave tubes driving linear accelerators. In this application, the high-power RF switch is placed at the coupling iris between the charging waveguide and the resonant storage line of a pulse compression system. This optically controlled high power RF pulse compression system can handle hundreds of Megawatts of power at X-band.

9 Claims, 8 Drawing Sheets

ACTIVE HIGH-POWER RF SWITCH AND PULSE COMPRESSION SYSTEM

CROSS-REFERENCE TO RELATED APPLICATIONS

This application claims priority from U.S. patent applications 60/016,624 and 60/016,625, both filed on May 1, 1996. Both applications are incorporated herein by reference.

FIELD OF THE INVENTION

This invention relates generally to high power microwave switching. More particularly, it relates to such switching through the use of solid state materials, and applications of such switching to radio frequency pulse compression methods employing resonant delay lines for storing RF energy.

This invention was supported by the U.S. Department of Energy under contract DE-AC03-76F00515. The U.S. Government has certain rights in the invention.

SUMMARY OF THE INVENTION

The invention provides techniques for high speed switching of very high power RF signals. Using these techniques, it is now possible for the first time to control and manipulate very high power microwave signals, and to obtain unprecedented performance in RF pulse compression systems which employ these techniques.

The switch is a three-port active device with similar ports 1 and 2. Placed across the cross-section of the port 3 is a semiconductor material, such as a silicon wafer. A controllable source of directed energy, such as a suitable laser or electron beam, is aimed at the semiconductor material. When the source is turned on, the energy incident on the wafer induces an electron-hole plasma layer on the wafer, changing the wafer's dielectric constant, turning port 3 into a termination for incident RF signals, and causing all incident RF signals to be reflected from the surface of the wafer. Therefore, depending on how the source is controlled, the propagation constant of RF signals through port 3 can be changed. Consequently the coupling between port 1 and port 2 can be continuously varied from 0 to 1.

It is a significant feature of the present invention that a technique is provided for preventing destruction of the silicon wafer by the high power RF fields. In particular, by making the RF coupling to the third port as small as necessary, one can reduce the peak electric field on the unexcited silicon surface for any level of input power from port 1. When the electron-hole plasma layer is excited on the wafer surface and port 3 is in resonance with the RF signal, the electric field is also small on the wafer surface. Therefore, there is no risk of damaging the wafer by RF with high peak power irrespective of whether port 3 is active or not. Moreover, the switch is designed to operate in the $TE_{01}$ mode in a circular waveguide to avoid the edge effects present at the interface between the silicon wafer and the supporting waveguide, thereby enhancing its power handling capability.

An important application of the switch is to the construction of an improved pulse compression system to boost the peak power of microwave tubes driving linear accelerators. In this application, the high-power RF switch is placed at the coupling iris between the charging waveguide and the resonant storage line of a pulse compression system. By precisely controlling the switch, significant improvements over prior pulse compression systems are obtained. In particular, the coupling to the resonant delay lines is optimized for maximum energy storage during the charging phase. In addition, the switch maximizes the discharge of the lines by increasing the coupling to the lines just before the start of the output pulse. Turning the switch on once during the power input or charging period allows more RF energy to be put in the storage line by reducing the amount of energy reflected at the delay line entrance. Independently, the switch can also be turned on once just before discharging the storage line to increase the coupling of the line, thus allowing more energy to be discharged from the line during the compressed pulse time period. It is an important feature of the present invention that an actively controlled change in a reflection coefficient, such as is provided by the switch, is coordinated with a change in signal phase to help dump RF energy from an RF storage line, and to improve the performance of an RF pulse compression system.

This optically controlled high power RF pulse compression system can handle hundreds of Megawatts of power at X-band. Such pulse compression systems also have applications to other high power RF devices and systems such as various medical applications and remote sensing (i.e. wideband radar). In addition, appropriately chosen parameters of the device make the invention applicable in broadening the bandwidth of high power RF sources such as klystrons and magnetrons, which are typically narrowband devices, by actively detuning their cavities. Such an application has significance in radar systems. To date, there are no active devices that can control and manipulate multi-megawatt microwave signals. The 3-port active device in this invention makes such control and manipulation of high power microwave signals possible.

BRIEF DESCRIPTION OF THE DRAWING FIGURES

DETAILED DESCRIPTION

Although a high-power RF switch according to the principles of the present invention is described below primarily in the context of a pulse compression system for a linear accelerator, those skilled in the art will recognize that the invention is not thereby limited to that context, but has applications to many various high-power RF technologies.

Radio frequency (RF) pulse compression systems are typically used in research accelerators to increase their peak power. The SLED Pulse compression system at SLAC, for example, was implemented to enhance the performance of the two mile long accelerator structure. One drawback of SLED is that it produces an exponentially decaying pulse. The SLED II pulse compression system is an improvement of SLED that gives a flat output pulse and higher intrinsic efficiency than SLED, and is more compact than other techniques.

The SLED II pulse compression system employs high Q resonant delay lines to store the energy during most of the duration of the incoming pulse. The round trip time of an RF signal through one of the delay lines determines the length of the compressed pulse. To discharge the lines, the phase of the incoming pulse is reversed 1800 so that the reflected signal from the inputs of the lines and the emitted field from the lines add constructively thus, forming the compressed, high power, pulse.

The SLED II system suffers from two types of losses that reduce its intrinsic efficiency. During the charging phase some of the energy is reflected at the delay line entrance, and never gets into the lines. Also, after the phase of the pulse is reversed, the energy inside the lines is not discharged completely in one compressed pulse time period. These two effects make the intrinsic efficiency of SLED II deteriorate very fast at large compression ratios.

The pulse compression system of the present invention is an improvement on SLED II that enhances its intrinsic efficiency without increasing its physical size. In particular, to reduce the amount of energy left-over after the output pulse is finished one can increase the coupling of the line just before the start of the output pulse. This will allow more energy to get out of the storage line during the compressed pulse time period. To reduce the losses due to reflections during the charging of the delay lines, one can optimize the constant line coupling for maximum energy storage.

Figure 7:
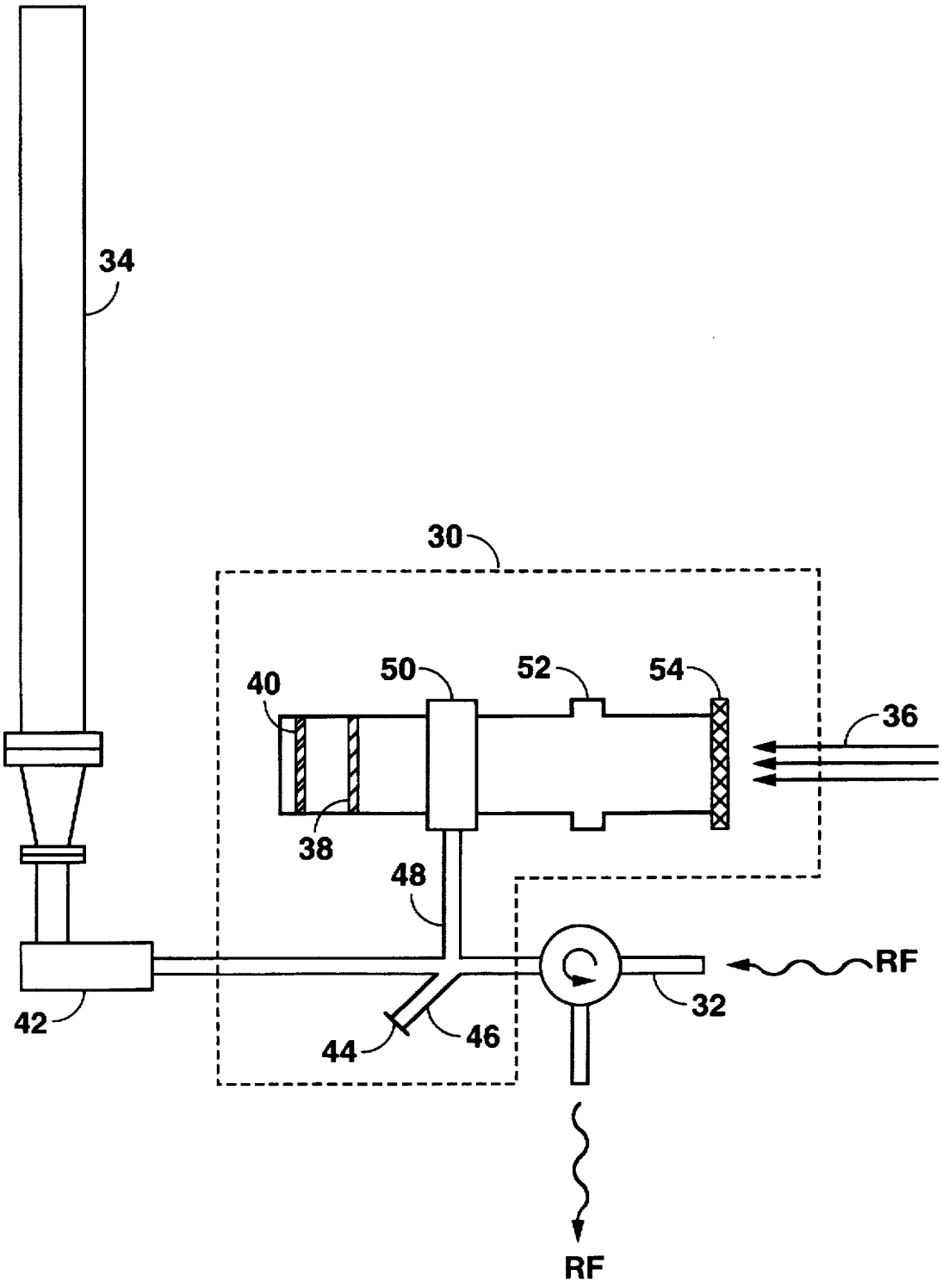
FIG. 7 is a schematic diagram of a preferred embodiment of the invention, illustrating the active RF switch as applied to an improved RF pulse compression system.

To change the coupling coefficient of the storage lines, a fast high-power microwave switch of the present invention is employed. The RF switch 30, as shown in FIG. 7, is placed at the coupling iris between the input (i.e., charging) waveguide 32 and the resonant storage line 34. Laser light 36, or alternatively an electron beam, is used to control the dielectric constant of a semiconductor 38 positioned in port 3 of the switch. The changes in the dielectric constant change the reflection coefficient of port 3 between two values within a certain time interval. The reflection properties of port 3 depend in part upon the positions of the semiconductor 38 and the short circuit plate 40 behind it.

The switch can be turned on once during the power input or charging period, allowing more RF energy to be put in the storage line. The same switch can also be turned on once just before discharging the storage line, thus allowing all the energy to be discharged from the line. Either method of switching the iris once provides significant improvements in system efficiency over a conventional, unswitched pulse compression system such as SLED II. Both methods of switching can be used together for optimal performance.

The first method of switching the iris once provides high efficiency for a system with pulse compression ratios of 5 or less. For example, at a pulse compression ratio of 3, SLED II has an efficiency of 88.7% while the switched system has an efficiency of 98.9%. To maintain high efficiency in a system with compression ratios greater than 5, the second method of switching the iris once during discharging can be used. For example, at a pulse compression ratio of 16, SLED II has an efficiency of 40.6% while the switched system has an efficiency of 82.7%. By turning on the switch twice, i.e., once during the time period of charging the resonant storage line, and once again during the discharging of the line, efficiencies much higher than those of current pulse compression systems can be realized for a broad range of compression ratios. For example, at a pulse compression ratio of 16, the twice-switched system has an efficiency of 92.6%. The technique also generates output pulses which are flat and phase stable.

The design can handle, in principle, multi-megawatt microwave signals. Past experience with high power microwave ceramic windows suggests that a higher peak power handling capability may be obtained by avoiding any electrical field at the interface between the semiconductor wafer and the walls of the supporting waveguide. Hence, the switch is designed to operate at the $TE_{01}$ mode in a circular waveguide.

Specific theory and techniques are now disclosed for optimizing the efficiency of the pulse compression system using a change in line coupling. Techniques are also disclosed for controlling the coupling between two of the ports by actively changing the termination of the third port. Specific details are provided also for the design of the optical switch.

Active pulse compression with several time events can be understood from a consideration of the following special case of a single event switched pulse compression system.

Passive Pulse Compression

Figure 1:
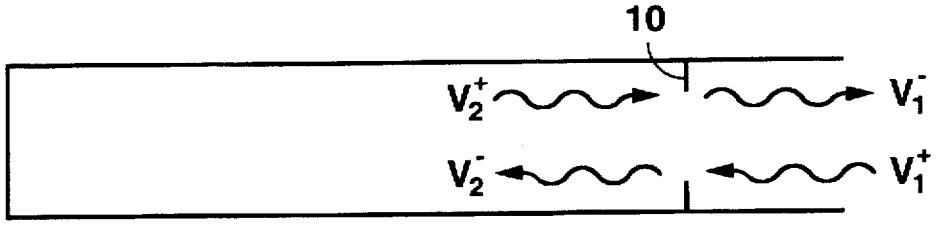
FIG. 1 (PRIOR ART)
FIG. 1 is a schematic illustration of a conventional waveguide resonant delay line with a coupling iris.

Consider the waveguide resonant delay line with a coupling iris 10 as shown in FIG. 1. The lossless scattering matrix representing the iris is unitary. At a certain reference plane the matrix takes the following form:

$$\underline{\underline{S}} = \begin{pmatrix} -R_0 & -j(1-R_0^2)^{1/2} \\ -j(1-R_0^2)^{1/2} & -R_0 \end{pmatrix}. \tag{1}$$

In writing Eq. (1) we assume a symmetrical structure for the iris two port network. The forward and reflected fields around the iris are related as follows:

$$V_1^- = -R_0 V_1^+ - j(1-R_0^2)^{1/2} V_2^+, \tag{2}$$

$$V_2^- = -j(1-R_0^2)^{1/2} V_1^+ - R_0 V_2^+. \tag{3}$$

With the exception of some phase change, the incoming signal $V_2^+$ at time instant t is the same as the outgoing signal $V_2^-$ at time instant t-τ; where τ is obviously the round trip delay through the line; i.e.

$$V_2^+(t) = V_2^-(t-\tau)e^{-j2\beta}; \tag{4}$$

where β is the wave propagation constant within the delay line, and l is the length of the line. Substituting from Eq. (4) into Eq. (3) we get $$V_2^-(t) = -j(1-R_0^2)^{1/2} V_1^+(t) - R_0 V_2^-(t-\tau)e^{-j2\beta}. \tag{5}$$

During the charging phase we assume a constant input, i.e., $V_1^+(t)=Vin$ which equals a constant value. We, also, assume that all the voltages are equal to zero at time t<0. Hence, substituting the solution of the difference equation (5) into Eq. (4) leads us to write $$V_2^+ = -j\frac{1-(-R_0e^{-j2\beta l})^i}{1+R_0e^{-j2\beta l}}(1-R_0^2)^{1/2}e^{-j2\beta l}V_{in}. \tag{6}$$

In Eq. (6) $V_2^+(i)$ means the incoming wave in the time interval $i\tau \leqq t < (i+1)\tau$ and $i \geqq 0$. Substituting from Eq. (6) into Eq. (2) we get $$V_1^-(i) = -V_{in}\left[R_0 + (1-R_0^2)\frac{1-(-R_0e^{-j2\beta l})^i}{1+R_0e^{-j2\beta l}}e^{-j2\beta l}\right]. \tag{7}$$

If the delay line has small losses ($\beta$ has a small imaginary part), at resonance the term $$e^{-j2\beta l} = -p. \tag{8}$$

where p is a positive real number close to 1. Eq. (7) becomes $$V_1^-(i) = -V_{in}\left[R_0 - (1-R_0^2)\frac{1-(R_0p)^i}{1-R_0p}p\right]. \tag{9}$$

After the energy has been stored in the line one may dump part of the energy in a time interval $\tau$ by flipping the phase of the incoming signal just after a time interval $(n-1)\tau$, .i.e., $$V_1^+(t) = \begin{cases} V_{in} & 0 \leqq t < (n-1)\tau \\ -V_{in} & (n-1)\tau \leqq t < n\tau \\ 0 & \text{otherwise.} \end{cases} \tag{10}$$

The output pulse level during the time interval $(n-1)\tau \leqq t < n\tau$ can be calculated from Eq. (2) with the aid of Eq.(6). The result is $$V_{out} = V_1^-(n-1) = V_{in}\left[R_0 + (1-R_0^2)\frac{1-(R_0p)^{n-1}}{1-R_0p}p\right]. \tag{11}$$

Indeed, this is the essence of the SLED II pulse compression system.

Figure 2:
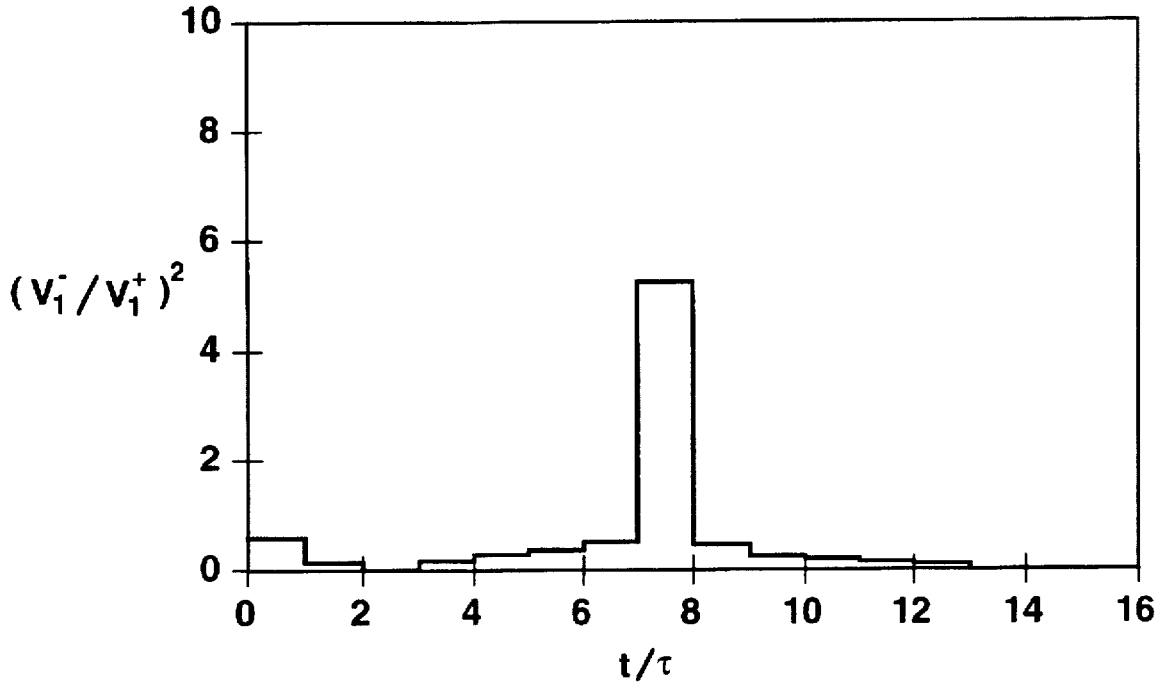
FIG. 2 (PRIOR ART)
FIG. 2 is a graph of SLED II power gain output vs. $t/\tau$ in the case where the compression ratio is 8.

To illustrate the sources of inefficiency of the SLED II system we plot the output $V_1^-(t)$ vs. time, as shown in FIG. 2. In this graph n=8, and the value $R_0$=0.733. This value maximizes Eq. (11). Initially, the line is empty and a large portion of the incident power is reflected. Gradually, the reflected power decreases as the line is filled with energy. The reflected power starts to increase again as the line becomes almost fully charged. After the phase of the incoming signal is reversed, the compressed pulse appears. However, not all the energy of the line is dumped out; some of it is still in the line. This energy leaks out gradually after the compressed pulse.

The maximum power gain of SLED II is limited. Using Eq. (11), the power gain as $n \to \infty$ is, $$\left(\frac{V_{out}}{V_{in}}\right)^2\Bigg|_{n\to\infty} = \left[R_0 + (1-R_0^2)\frac{p}{1-R_0p}\right]^2; \tag{12}$$

which has a maximum value of $$\text{Maximum Power Gain} = \frac{17}{p^2} - 8 - \frac{12\sqrt{2(1-p^2)}}{p^2} \tag{13}$$

at

-continued $$R_0 = \frac{1}{p} - \frac{\sqrt{8(1-p^2)}}{4p}. \tag{14}$$

Clearly the maximum power gain is limited to 9 as $p \to 1$. Furthermore, this maximum is greatly affected by the losses in the delay line; for example, the gain is limited to 7.46 if the line has a 1% round trip power losses.

Active Switching During Charging Time

During the charging period the power reflected from the line reaches a maximum during the first time interval $\tau$. Hence, one could initially make the iris reflection coefficient zero. After the first time interval $\tau$ we could switch the iris so that the reflection coefficient has a value $R_0$. Under these conditions, the difference equation (5) can be solved with the initial condition $$V_2^-(0) = -jV_{in}. \tag{15}$$

Solving Eq. (5) and substituting into (4) we get $$V_2^+(i) = -je^{-j2\beta l}\left[\frac{1-(-R_0e^{-j2\beta l})^{i-1}}{1+R_0e^{-j2\beta l}}(1-R_0^2)^{1/2} + (-R_0e^{-j2\beta l})^{i-1}\right]V_{in}. \tag{16}$$

Assuming a resonant line and flipping the phase according to Eq. (10) the output pulse expression takes the following form $$V_{out} = \left[\frac{1-(R_0p)^{n-2}}{1-R_0p}(1-R_0^2)p + (1-R_0^2)^{1/2}p(R_0p)^{n-2} + R_0\right]V_{in}. \tag{17}$$

Again the choice of the value of $R_0$ is such that $V_{out}$ is maximized.

Active Switching during delay line Discharge

Case 1: Discharging After The Last Time Bin

To discharge the line, one can keep the input signal at a constant level during the time interval $0 \leqq t < n\tau$ but switching the iris reflection coefficient to zero so that all the energy stored in the line is dumped out. In this case $$V_{out} = \frac{1-(R_0p)^n}{1-R_0p}(1-R_0^2)^{1/2}pV_{in}. \tag{18}$$

Case 2: Switching Just Before The Last Time Bin

To reduce the burden on the switch one can reverse the phase together with changing the iris reflection coefficient. In this case all the energy can still be dumped out of the line, but the iris reflection coefficient need not be reduced completely to zero. During the discharge interval the new iris S matrix parameters can be written in the following form:

$$S = \begin{pmatrix} -\cos(\theta) & -j\sin(\theta) \\ -j\sin(\theta) & -\cos(\theta) \end{pmatrix}. \tag{19}$$

Applying Eq. (19) into Eq. (3) while setting $V_2$=0 leads us to write $$R_d = \cos\left[\tan^{-1}\left(\frac{1-(R_0p)^{n-1}}{1-R_0p}(1-R_0^2)^{1/2}p\right)\right]. \tag{20}$$

This new reflection coefficient is greater than zero and the switch need only change the iris between $R_0$ and $R_d$. Applying Eq. (16) into Eq. (2), the output reduces to $$V_{out} = R_d \left[ 1 + \left( \frac{1-(R_0 p)^{n-1}}{1-R_0 p} \right)^2 (1-R_0^2)p^2 \right] V_{in}. \tag{21}$$

Figure 3:
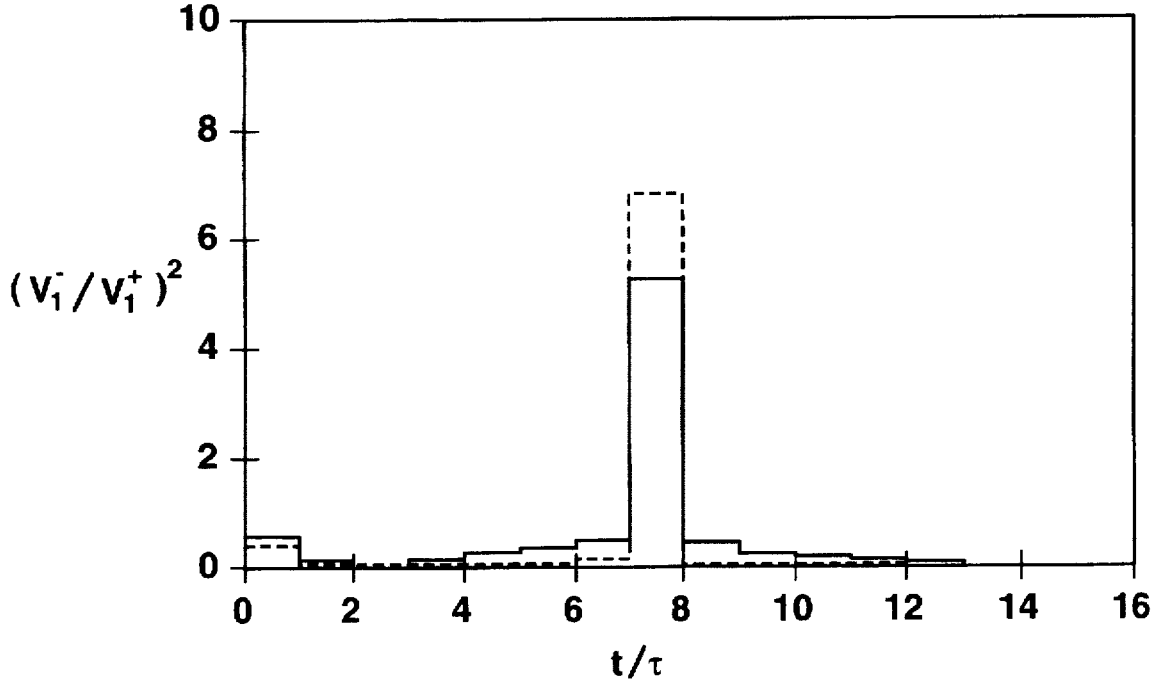
FIG. 3 is a graph of SLED II power gain output vs. $t/\tau$ for two pulse compression systems in the case where the compression ratio is 8. The solid line represents the SLED II output, while the dashed line represents the output using a switched pulse compression system according to the present invention.

The compressed pulse takes place in the interval $(n-1)\tau \leqq t < n\tau$. The optimum value of $R_0$ is such that it fills the system with maximum possible amount of energy in the time interval $(n-1)\tau$ instead of $n\tau$ in the previous case. Unlike the previous case the incident power during this interval will not be coupled to the line nor suffer from a round trip loss. Therefore, the system, in this case, has a higher efficiency. FIG. 3. shows an example of this case.

For both cases of discharging by active switching, the maximum power is $$\text{Maximum Power Gain} = \frac{p^2}{1-p^2}\ ; \tag{22}$$

which occurs at $$R_0 = p. \tag{23}$$

Unlike the passive system, the maximum power gain has no intrinsic limit. It is only limited by the amount of losses in the storage line. In this case the gain can be much higher than 9, which is the limit of the passive system.

Effect of losses

Figure 4:
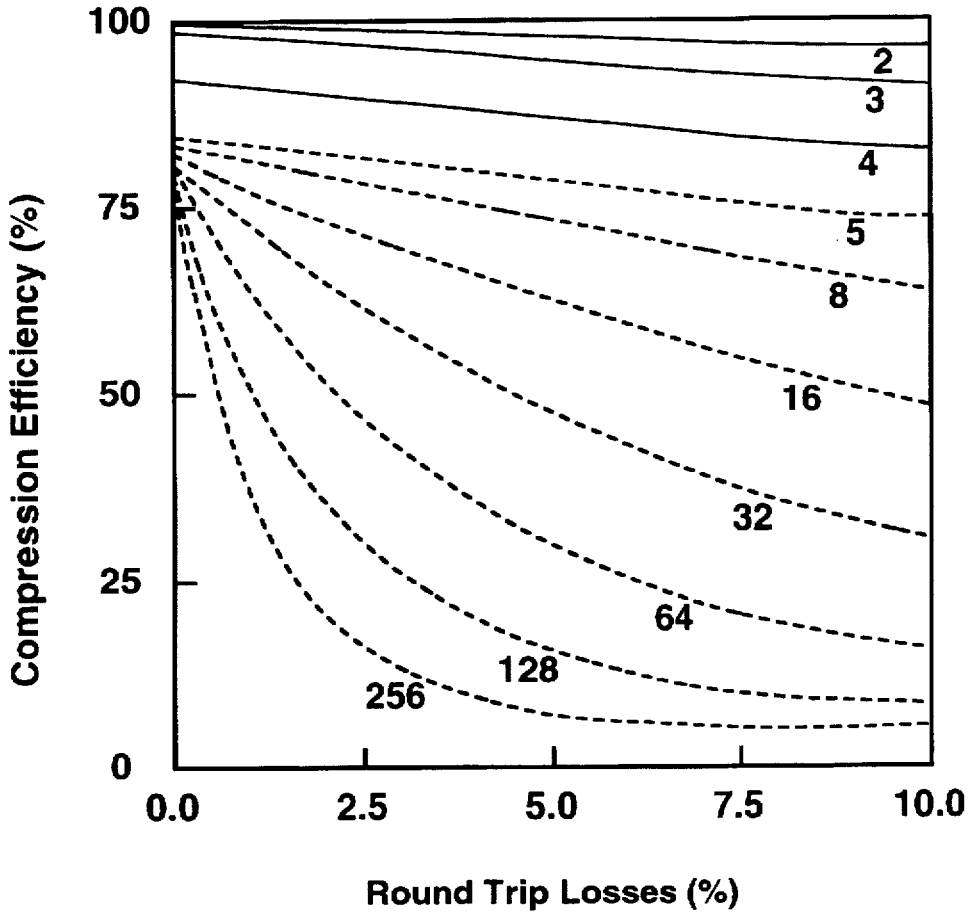
FIG. 4 is a graph of compression efficiency vs. round trip losses for various different compression ratios, illustrating the effect of line and switching iris losses on compression efficiency for a one time switched resonant delay line.

As the compression ratio increases, the stored energy spends more time in the storage lines resulting in a reduction in efficiency due to the finite quality factor of the lines. FIG. 4 shows the effect of losses for different compression ratios. The round trip line loss plus reflection losses at the end of the line plus reflection losses at the active iris is defined as $$\text{Round Trip Power Loss} = 1 - p^2 \tag{24}$$

In FIG. 4, for a given $C_r$, the method used to switch the iris is the optimum one for this particular $C_r$.

At the last time bin the phase of the incoming signal is flipped and the coupling iris reflection coefficient changes from $R_0$ to $R_d$. Table 1 shows the optimum coupling iris reflection coefficient in both cases. As the compression ratio, $C_r$, increases, the efficiency of SLED II decreases dramatically; while that of the active system remains above 81%.

Table 1. compares the different types of pulse compression systems. It also gives the optimum system parameters for each compression ratio $C_r$; here $C_r$ is defined as the total time interval divided by the duration of the compressed pulse, i.e., $\eta$. The efficiency of the system $\eta$, is defined as the energy in the compressed pulse divided by the total incident energy, namely $$\eta = \frac{1}{C_r} \left( \frac{V_{out}}{V_{in}} \right)^2. \tag{25}$$

In these calculations we assume a lossless system, i.e., p=1.

TABLE 1

Comparison between different methods of single event switching pulse compression systems.

| | | | | | Discharging By Active Switching | | | | |
|---|---|---|---|---|---|---|---|---|---|
| | SLED II | | Switching During Charging Time | | Discharging After The Last Time Bin | | Discharging Just Before the Last Time Bin | | |
| | | Opt. | | Opt. | | Opt. | | Opt. | |
| $C_r$ | $\eta$(%) | $R_0$ | $\eta$(%) | Opt. $R_0$ | $\eta$(%) | $R_0$ | $\eta$(%) | $R_0$ | $R_d$ |
| 2 | 78.1 | 0.5 | 100 | 0.707 | 84.4 | 0.5 | 100 | 0.0 | 0.707 |
| 3 | 88.7 | 0.548 | 98.9 | 0.631 | 82.7 | 0.646 | 89.6 | 0.5 | 0.610 |
| 4 | 86.0 | 0.607 | 92.6 | 0.658 | 82.1 | 0.725 | 87.0 | 0.646 | 0.536 |
| 5 | 80.4 | 0.651 | 85.1 | 0.688 | 81.9 | 0.775 | 85.7 | 0.725 | 0.483 |
| 6 | 74.6 | 0.685 | 78.1 | 0.714 | 81.8 | 0.809 | 84.9 | 0.775 | 0.443 |
| 8 | 64.4 | 0.733 | 66.5 | 0.754 | 81.6 | 0.854 | 84.0 | 0.835 | 0.386 |
| 10 | 56.2 | 0.767 | 57.7 | 0.783 | 81.6 | 0.882 | 83.4 | 0.869 | 0.346 |
| 12 | 49.9 | 0.792 | 50.9 | 0.805 | 81.5 | 0.900 | 83.1 | 0.892 | 0.317 |
| 16 | 40.6 | 0.828 | 41.2 | 0.837 | 81.5 | 0.924 | 82.7 | 0.920 | 0.275 |
| 24 | 29.6 | 0.869 | 29.8 | 0.875 | 81.5 | 0.949 | 82.2 | 0.947 | 0.225 |
| 32 | 23.3 | 0.893 | 23.4 | 0.897 | 81.5 | 0.961 | 82.0 | 0.960 | 0.195 |
| 64 | 12.6 | 0.936 | 12.7 | 0.938 | 81.5 | 0.981 | 81.7 | 0.980 | 0.138 |
| 128 | 6.6 | 0.962 | 6.6 | 0.963 | 81.5 | 0.990 | 81.6 | 0.990 | 0.099 |
| 256 | 3.4 | 0.978 | 3.4 | 0.979 | 81.5 | 0.995 | 81.5 | 0.995 | 0.069 |

At small values of $C_r$, switching the iris just after the first time bin is the most efficient solution. When $C_r > 5$, switching the iris just before the last time bin while reversing the phase by 180° is more efficient. At high compression ratios, the last time bin does not contribute much. Hence, switching the iris after the last time bin is almost equivalent to switching it just before the last time bin. For applications that require one pulse compression system or several pulse compression systems with no phase synchronization, switching after the last time bin may be advantageous because it can use an oscillator as the primary RF source instead of an amplifier or a phase locked oscillator.

In general, switching the line just before the last time bin is the most advantageous technique. For reasonably high compression ratios the change in the iris reflection coefficient is relatively small. This simplifies the high power implementation of the active iris. Also, the losses in the delay line make the efficiency of the system deteriorate with higher compression ratios. Clearly, the active system is advantageous at high compression ratios. However, it soon loses its advantage because of delay line losses. Between the compression ratios of 6 and 32 the active system has a significant advantage over the passive one. At the same time the delay line losses do not reduce its efficiency in a significant way.

Microwave Control Using A Symmetric Three Port Network

Figure 5:
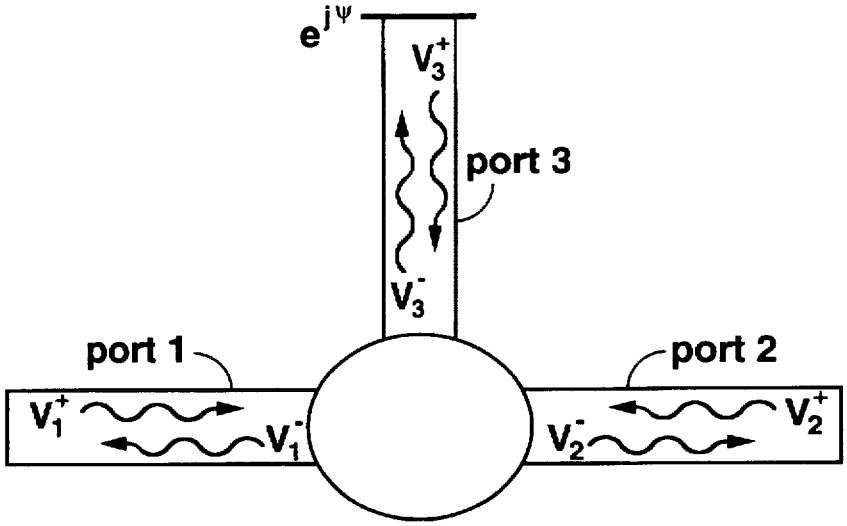
FIG. 5 is a schematic diagram of a symmetric three port network whose third arm is terminated with a short circuit.

Consider the device shown in FIG. 5 composed of three ports coupled at a common junction. The lossless three port device has two similar ports, namely, port 1 and port 2. Port 3 is terminated so that all the scattered power from that port is completely reflected. However, the phase of the reflected signal from the third port can be changed actively. For any lossless and reciprocal 3-port network the scattering matrix is unitary and symmetric. By imposing these two conditions on the scattering matrix $\underline{\underline{S}}$ of our device and at the same time taking into account the symmetry between port 1 and port 2, at some reference planes, one can write:

$$\underline{\underline{S}} = \begin{pmatrix} \frac{e^{j\phi}-\cos\theta}{2} & \frac{-e^{j\phi}-\cos\theta}{2} & \frac{\sin\theta}{\sqrt{2}} \\ \frac{-e^{j\phi}-\cos\theta}{2} & \frac{e^{j\phi}-\cos\theta}{2} & \frac{\sin\theta}{\sqrt{2}} \\ \frac{\sin\theta}{\sqrt{2}} & \frac{\sin\theta}{\sqrt{2}} & \cos\theta \end{pmatrix}; \tag{26}$$

Indeed, with the proper choice of the reference planes, this expression is quite general for any symmetric three port network. The scattering matrix properties are determined completely with only two parameters: $\theta$ and $\phi$. The scattered RF signals $\underline{V}^-$ are related to the incident RF signals $\underline{V}^+$ by $$\underline{V}^- = \underline{\underline{S}}\underline{V}^+; \tag{27}$$

where $V_i^{\pm}$ represents the incident/reflected RF signal from the $i^{th}$ port. We terminate the third port so that all the scattered power from that port is completely reflected; i.e., $$V_3^+ = V_3^- e^{j\Psi}. \tag{28}$$

The resultant, symmetric, two port network, then, has the following scattering matrix parameters:

$$S_{11} = S_{22} = \frac{(e^{j\psi}+e^{j\phi}) - (1+e^{j(\phi+\psi)})\cos\theta}{2(1-\cos\theta e^{j\psi})}, \tag{29}$$

$$S_{12} = S_{21} = \frac{(e^{j\psi}-e^{j\phi}) - (1-e^{j(\phi+\psi)})\cos\theta}{2(1-\cos\theta e^{j\psi})}. \tag{30}$$

By changing the angle $\Psi$ of the third, port terminator, the coupling between the first and the second ports can vary from 0 to 1. It is an important feature of the present invention that the coupling values need not be 0 and 1, but may be selected to be any value between 0 and 1.

The signal level at the third arm is, then, given by:

$$|V_3^+|^2 = |V_3^-|^2 = \frac{\sin^2\theta}{3-4\cos\theta\cos\psi+\cos 2\theta}\,|V_1^+ + V_2^+|^2. \tag{31}$$

This signal level is independent of the parameter $\phi$, and has a maximum or a minimum value at $\Psi=0$ or $\pi$.

The Optical Switch

A. Device Physics

To actively change the angle of the reflection coefficient at port 3 we place a piece of semiconductor material in the third arm. An external stimulus such as a laser light can induce an electron-hole plasma layer at the surface of the semiconductor, thus changing its dielectric constant. Therefore, the propagation constant of RF signals through the active arm changes; and consequently the coupling between the other two ports also changes.

For the pulse compression system application associated with the Next Linear Collider (NLC), for which we choose a compression ratio of 8, it is required to change the reflection coefficient at the first arm between two fixed values, which are not necessarily 0 and 1. The device should remain in one state for approximately 1.75 μsec, and in the other state for 250 nsec. Since silicon has a carrier lifetime that can extend from 1 μsec to 1 msec it seems like a natural choice for this application. One can excite the plasma layer with a very short pulse from the external stimulus (about 5 nsec) and the device will stay in its new status longer than the duration of the RF signal. Since repetition rate for this pulse compression system is 180 pulse/sec there is sufficient time between pulses for the switch to completely recover.

To be useful, this switch needs to have very small losses. Following classical arguments, one can show that the dielectric constant of a semiconductor material is $$\epsilon = \epsilon_0\epsilon_r\left(1 - \sum_i \frac{X_i}{1-jZ_i}\right); \tag{32}$$

where $$X_i = \frac{N_i e^2}{\epsilon_0\epsilon_r m_i^* \omega^2}, \tag{33}$$

$$Z_i = \frac{v_i}{\omega}, \tag{34}$$

where $\omega$ is the radial frequency of the RF signal, $m_i^*$ is the effective mass of carrier i (electron, light hole and heavy hole), $N_i$ is carrier density, e is the electron charge, and $v_i$ is the collision frequency. This latter quantity is related to the measured values of the dc mobility $\mu_i$ as follows:

$$\frac{1}{v_i} = \frac{\mu_i m_i^*}{e}. \tag{35}$$

Comparison between estimates of $v_i$ for silicon at 11.424 GHz, the operating frequency of the NLC, shows that $Z_i >> 1$. Hence, one can show that the dielectric constant is given by the classical relation $$\epsilon = \epsilon_0\epsilon_r\left(1 - j\frac{\sigma}{\omega\epsilon_0\epsilon_r}\right); \tag{36}$$

where $$\sigma = e\sum_i \mu_i N_i, \tag{37}$$

which is the conductivity of the semiconductor.

To minimize the losses in the off state, i.e., when there is no plasma excited, we need to have a very pure semiconductor material such that the intrinsic carrier density is very small. In the On state, i.e., when the plasma layer is excited, the carrier density should be large enough so that the semiconductor acts like a good conductor and thus minimizing the losses.

At a carrier density of $10^{19}/cm^3$, silicon has a conductivity of about $3.3\times10^3$ mho/cm. This is two orders of magnitude smaller than that of copper. However, it is high enough to make an effective reflector. The skin depth of an RF signal at the NLC frequency at this conductivity level is about 8 μm. In choosing the laser wavelength to produce the photo-induced carriers, light penetration depth should be comparable to this skin depth.

B. Design Methodology

While charging the delay line with RF energy, the reflection coefficient of the coupling iris is $R_O$, as given in Table 1 for different compression ratios. Hence, the first design equation is $$|S_{11}|^2 = R_O^2 = \frac{\left(\cos\left(\frac{\phi+\psi_c}{2}-\theta\right)+\cos\left(\frac{\phi+\psi_c}{2}+\theta\right)-2\cos\left(\frac{\phi-\psi_c}{2}\right)\right)^2}{4-8\cos(\psi_c)\cos(\theta)+4\cos^2(\theta)}, \tag{38}$$

which follows immediately from Eq. (29). The angle $\Psi_c$ is the angle of the reflection coefficient of the third arm during the charging time. During the charging time, the charging signal is constant and is equal to $V_{in}$. Hence, using Eq. (31), and (6) one can write an expression for the field level in control arm (the third arm)

$$|V_3^+| = |V_3^-| = \frac{\sin\theta}{(3-4\cos\theta\cos\psi_c+\cos 2\theta)^{1/2}}\left|j\frac{1-(R_0p)^{C_r-2}}{1-R_0p}(1-R_0^2)^{1/2}p+1\right|V_{in} \tag{39}$$

During the charging time, we choose the angle $\Psi_c=\pi$. Eq. (38) then becomes $$R_0^2=\sin^2\frac{\phi}{2}\ . \tag{40}$$

That determines the angle $\phi$ completely. Eq. (39) becomes:

$$|V_3^+| = |V_3^-| = \frac{1}{\sqrt{2}}\tan\frac{\theta}{2}\left|j\frac{1-(R_0p)^{C_r-2}}{1-R_0p}(1-R_0^2)^{1/2}p+1\right|Vin. \tag{41}$$

During the discharging time the angle $\Psi$ would change from $\pi$ to the new value $\Psi_d$. Hence the active layer, i.e. silicon wafer will be placed at a point which has a reduced electric field by a factor of $\sin\Psi_d$. One then writes an expression for the maximum field seen by the silicon wafer during the charging time:

$$E_{max} = 2\left|\tan\frac{\theta}{2}\cos\frac{\psi_d}{2}\right|\left\|j\frac{1-(R_0p)^{C_r-2}}{1-R_0p}(1-R_0^2)^{1/2}p+1\right|\left(\frac{P_{in}Z_3}{A_3G_3}\right)^{1/2}; \tag{42}$$

where $P_{in}$ is the constant level input power, $Z_3$ is the wave impedance of the mode excited in the waveguide that forms the third arm, $A_3$ is the cross sectional area of that guide, and $G_3$ is a geometrical factors that depends on the mode and the waveguide shape of the third arm. The angle $\Psi_d$ should satisfy:

$$|S_{11}|^2 = R_d^2 = \frac{\left(\cos\left(\frac{\phi+\psi_d}{2}-\theta\right)+\cos\left(\frac{\phi+\psi_d}{2}+\theta\right)-2\cos\left(\frac{\phi-\psi_d}{2}\right)\right)^2}{4-8\cos(\psi_d)\cos(\theta)+4\cos^2(\theta)}; \tag{43}$$

where $R_d$ is given by Eq. (20), and its numerical values is tabulated in Table 1. Finally at the discharging time the signal level at the third arm is given by:

$$|V_3^+| = |V_3^-| = \frac{\sin\theta}{(3-4\cos\theta\cos\psi_d+\cos 2\theta)^{1/2}}\left|j\frac{1-(R_0p)^{C_r-1}}{1-R_0p}(1-R_0^2)^{1/2}p-1\right|V_{in}, \tag{44}$$

which leads us to write an expression for the amount of losses in the silicon wafer during the discharging time, $P_l$:

$$P_l=\left(\frac{2\sin\theta}{(3-4\cos\theta\cos\psi_d+\cos 2\theta)^{1/2}}\left|j\frac{1-(R_0p)^{C_r-1}}{1-R_0p}(1-R_0^2)^{1/2}p-1\right|\right)^2\frac{R_s}{Z_3}P_{in}; \tag{45}$$

where $R_S$ is the surface resistance and is given by $$R_s=\left(\frac{\omega\mu_0}{2\sigma}\right)^{1/2}. \tag{46}$$

The value of the conductivity $\sigma$ is given by Eq. (37). Clearly one wants to use as much laser power as possible to maximize $\sigma$.

Equations (40), (42), (43), and (45) are the design equations. The goal of the design is to reduce the electric field below 100 kV/cm during the charging time; which is the estimated breakdown field for a silicon wafer with a relatively large size. At the same time one should keep the losses in the silicon wafer below a certain limit so that the temperature of the wafer does not rise above a certain temperature, say 70 C°. If this temperature is exceeded, a risk of thermal runaway exists; as the silicon wafer gets hotter the losses, during discharging time increase, causing the temperature rise further until the silicon wafer becomes conductive because of thermal effects alone.

Switching Time

The calculations of the switching time of this system are governed by the filling time of the third arm. To calculate this time accurately one must know how all the system components behave with frequency. One can have a conservative estimate for that time by considering only the third arm at resonance. If this arm has an approximate length of one-half wavelength, and couples to the outside world with an iris that has a reflection coefficient equal to $\cos\theta$ ($S_{33}=\cos\theta$; see Eq. (25)) the filling time $T_f$ Then can readily shown to be $$T_f=\frac{-\left(1-\left(\frac{f_c}{f}\right)\right)^{-1/2}}{f\ln(\cos\theta)}; \tag{47}$$

where f is the operating frequency. This equation assumes that the third port is at resonance, however, in the real operation of the switch the third arm is never brought to resonance. Hence, the expression puts an upper limit on the switching time.

A Design Example

The power required to be generated from an RF station in the NLC Test Accelerator is 400 MW at a pulse width of 250 ns, at 11.424 GHz. This can be produced using the proposed 75 MW periodic permanent magnet focused klystrons while compressing the output of these klystrons with a compression ratio of 8 and assuming a compression efficiency of 75%. To compress the RF signal efficiently by a factor of 8, the magnitude of the reflection coefficient of an iris needs to change between 0.835 and 0.386.

We choose to operate the active arm at the $TE_{01}$ mode of a circular waveguide. We choose this mode of operation because it has no normal field near the walls. Hence, one need not worry about the details of high field operation at the interface between the silicon wafer and the waveguide walls. The geometrical factor $G_3$, which appears in Eq. (42) equals 0.479 for that mode. Then, using Eq. (40) the angle $\phi$=113.23°. We choose the radius of the third arm to be 2.78 cm. This radius will allow the $TE_{01}$ mode to propagate and will cutoff the $TE_{02}$ mode. We then choose the angle $\theta$=122.4°. This will make the rise time of the switch less than 2 nS (Eq. (47)). To satisfy Eq. (43), the angle $\Psi_d$=202.97°. The field amplitude in the third arm during the charging time is estimated with the help of Eq. (42) to be 95.5 kV/cm. Finally, according to Eq. (45), the losses of the switch during the discharging time is 4.5%.

Figure 6:
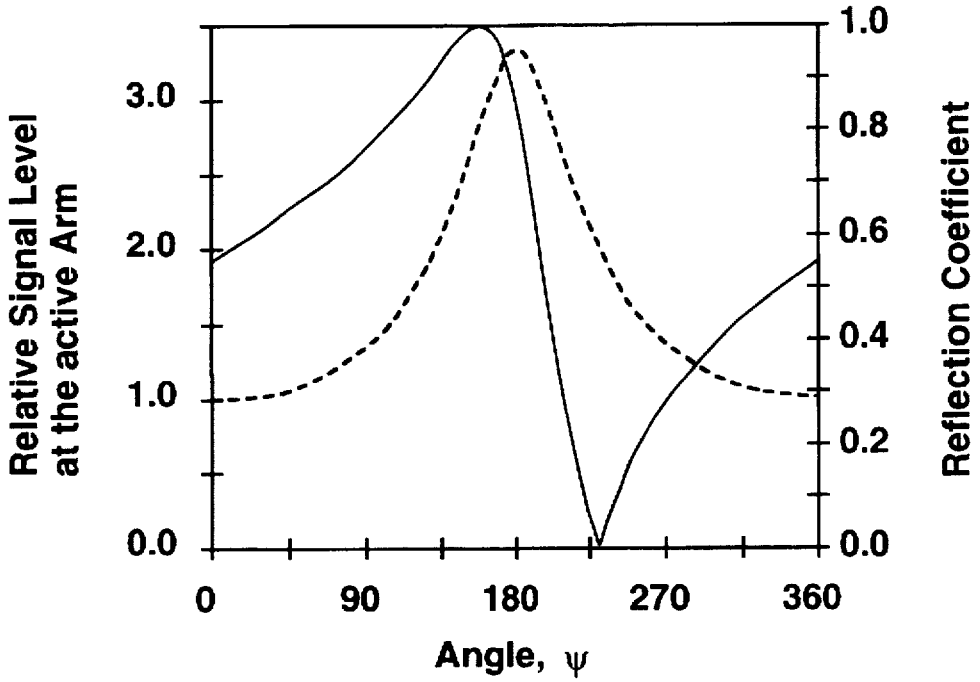
FIG. 6 is a graph of the reflection coefficient (solid line) and the relative field level at the active arm (dashed line) vs. the angle $\Psi$.

FIG. 6. shows both the relative signal level in the third arm (Eq. (39); $V_{in}$=1) and reflection coefficient ($S_{11}$ in Eq. (38)) as a function of the angle $\Psi$ for the switch parameters described above.

Proof of principle Experiment

FIG. 7 shows the schematic diagram of an active pulse compression system in accordance with the principles of the present invention. A conventional flower petal mode converter 42 and a long circular waveguide 34 act as the storage delay line. The waveguide is excited at the $TE_{01}$ mode. A matched magic tee, terminated with a short circuit 44 at the E arm 46 acts as the three port network. The $TE_{01}$ mode switching arm (third arm) is connected to the H arm 48 of the magic tee with a side coupled mode transducer 50. The circular guide representing the third arm is terminated from one side by a short circuit plate 40 and a 250 micron thick, 6000 ohm cm silicon wafer 38 is placed between the shorting plate 40 and the mode converter 50. From the other side of the mode converter, a $TE_{01}$ choke 52 acts as a terminator for this circular guide, while allowing the laser light 36 to reach the silicon wafer 38. A sapphire window 54 which is transparent to the laser light terminates the other side of the circular guide.

The switch is tuned by adjusting the shorting plate 40 until the field in the circular arm reaches a maximum (See FIG. 6). The field is observed by a small H probe placed near choke 52 during the cold test adjustments. This makes the angle $\Psi_c=\pi$. Then the circular guide is connected to the H arm 48 of the magic tee. The movable short 44, which is connected to the E arm 46 of the magic tee, is tuned until the reflection coefficient reaches $R_0$. Then, the laser is fired and the position of the silicon wafer 38 is adjusted to get a reflection coefficient equal to $R_d$.

Figure 8:
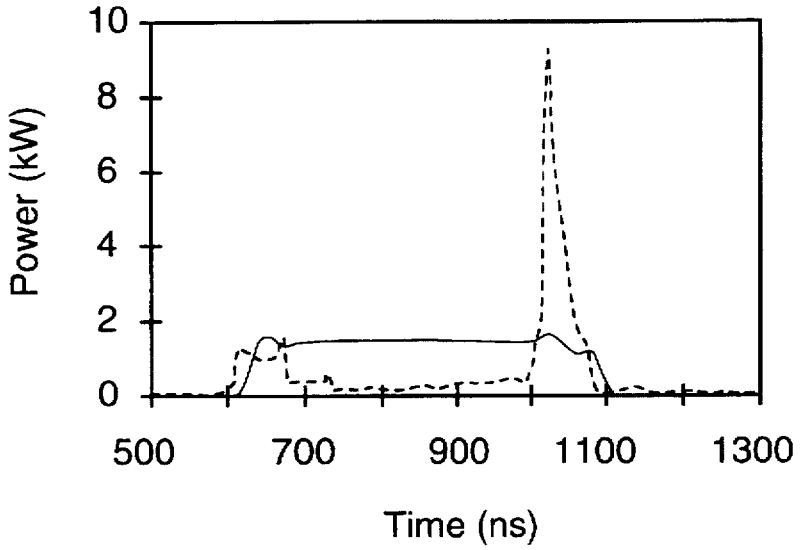
FIG. 8 is a graph of the measured power input (solid line) and output (dashed line) vs. time for a pulse compression system of the invention operating at a compression ratio of 8. The gain is 6 and the efficiency is 75%.

FIG. 8 shows the output of this system at a compression ratio of 8. The system has a gain of 6. The passive pulse compression system, SLED II, has a theoretical gain of 5.1, and if one assumes similar losses in the delay line SLED II gain would drop to 4.2. For a compression ratio of 32, the system has a gain of 11. SLED II has a theoretical gain of 7.4, and if one assume similar losses in the delay line SLED II gain would drop to about 5. Indeed, a gain of 11 is much more than the theoretical gain of any passive pulse compression system. These have a maximum gain of 9 as the compression ratio goes to infinity.

We claim:

1. A high-power RF device comprising:

a first port for carrying high-power RF energy;

a second port for carrying high-power RF energy and coupled to the first port at a junction;

a third port for carrying high-power RF energy and coupled to the first and second ports at the junction; and an E-arm coupled to the second port, wherein the E-arm acts to minimize the electric field at the third port;

wherein the third port is terminated by a short circuit plate and comprises a semiconductor wafer capable of changing the phase of RF signals reflected in the third port when the wafer is excited by a directed energy beam.

2. The device of claim 1 wherein the first port is terminated by a window transparent to light whose frequency is capable of exciting an electron-hole plasma in the semiconductor.

3. The device of claim 1 wherein the first port comprises a choke.

4. The device of claim 1 further comprising a delay storage line coupled to the second port.

5. The device of claim 4 further comprising a flower petal mode converter coupled to the second port and the delay storage line.

6. A method for controlling high-power RF signals, the method comprising:

coupling the RF signals into a three-port waveguide device having a semiconductor wafer positioned within one port of the device;

directing at the wafer a source of energy that is capable of changing the dielectric properties of the wafer; and modulating the intensity of the source of energy;

wherein the coupling of the RF signals minimizes the electric field at the wafer in the one port.

7. The method of claim 6 further comprising coupling the RF signals to a delay storage line.

8. The method of claim 6 further comprising coordinating a change in phase of the RF signals with the modulation of the intensity of the source of energy.

9. The method of claim 6 wherein the coupling of the RF signals minimizes the electric field at the wafer in the one port through the use of an E-arm.

* * * * *

UNITED STATES PATENT AND TRADEMARK OFFICE

CERTIFICATE OF CORRECTION

PATENT NO. : 5,796,314
DATED : 18 August 1998
INVENTOR(S) : Sami G. Tantawi et al.

It is certified that error appears in the above-identified patent and that said Letters Patent is hereby corrected as shown below:

In column 1, line 19, please replace "DE-AC03-76F00515" with --DE-AC03-76SF00515--.

Signed and Sealed this

Twenty-fourth Day of November, 1998

*Attest:*

*Attesting Officer*

BRUCE LEHMAN

*Commissioner of Patents and Trademarks*